US011712111B2

(12) United States Patent
Luise

(10) Patent No.: US 11,712,111 B2
(45) Date of Patent: Aug. 1, 2023

(54) ARCHIVE

(71) Applicant: MAKROS SRL, Ferrara (IT)

(72) Inventor: Massimo Luise, Ferrara (IT)

(73) Assignee: MAKROS SRL, Ferrara (IT)

( * ) Notice: Subject to any disclaimer, the term of this patent is extended or adjusted under 35 U.S.C. 154(b) by 0 days.

(21) Appl. No.: 17/297,702

(22) PCT Filed: Nov. 28, 2019

(86) PCT No.: PCT/IB2019/060280
§ 371 (c)(1),
(2) Date: May 27, 2021

(87) PCT Pub. No.: WO2020/110062
PCT Pub. Date: Jun. 4, 2020

(65) Prior Publication Data

US 2022/0079339 A1 Mar. 17, 2022

(30) Foreign Application Priority Data

Nov. 28, 2018 (IT) ..... 102018000010669

(51) Int. Cl.
*A47B 63/00* (2006.01)
*A47B 53/02* (2006.01)
(Continued)

(52) U.S. Cl.
CPC ..... *A47B 63/00* (2013.01); *A47B 53/02* (2013.01); *B65D 81/24* (2013.01); *E05G 1/024* (2013.01)

(58) Field of Classification Search
CPC ..... A47B 63/00; A47B 53/02; B65D 81/24; E05G 1/024
(Continued)

(56) References Cited

U.S. PATENT DOCUMENTS 1,164,123 A * 12/1915 Schaffert ..... E05G 1/024 220/592.2
1,692,271 A * 11/1928 Judelson ..... F26B 25/08 52/65
(Continued)

FOREIGN PATENT DOCUMENTS

| | | | |
|---|---|---|---|
| EP | 2497389 | A1 | 9/2012 |
| KR | 20120073776 | A | 7/2012 |
| WO | 2017064622 | A1 | 4/2017 |

OTHER PUBLICATIONS

International Preliminary Report on Patentability received for the International Application No. PCT/IB2019/060280, dated Nov. 6, 2020, 34 pages.

*Primary Examiner* — Janet M Wilkens
*Assistant Examiner* — Timothy M Ayres
(74) *Attorney, Agent, or Firm* — Leason Ellis LLP

(57) ABSTRACT

An archive (1000) comprising at least one prismatic box-shaped container (1) movable on guides extending in a given direction (D) to create a compactable archive (1000); the container (D comprising a plurality of substantially rectangular walls (4) which are connected end to end in a fluid-tight manner to delimit a volume (VL) accessible according to the direction (D) through at least one opening (A)(A'); peripheral frame members (20) being carried frontally by the walls (4) adapted to determine, in use, a fluid-tight closing condition of the volume (VL).

13 Claims, 3 Drawing Sheets

(51) Int. Cl.
*B65D 81/24* (2006.01)
*E05G 1/024* (2006.01)

(58) Field of Classification Search
USPC ..... 312/333
See application file for complete search history.

(56) References Cited

U.S. PATENT DOCUMENTS

| | | | | | |
|---|---|---|---|---|---|
| 2,239,128 | A * | 4/1941 | Sykes | B65D 81/3818 | 312/304 |
| 4,044,449 | A * | 8/1977 | Phan | F25D 23/063 | 264/46.7 |
| 4,547,026 | A | 10/1985 | French et al. | | |
| 5,069,513 | A * | 12/1991 | Farrell | A47B 53/02 | 104/295 |
| 5,582,472 | A * | 12/1996 | Lyons | E05C 9/06 | 312/294 |
| 8,997,436 | B2 * | 4/2015 | Spear | E04B 2/7401 | 52/800.1 |
| 2006/0108903 | A1 * | 5/2006 | Bauer | F25D 23/02 | 312/405 |
| 2009/0179532 | A1 * | 7/2009 | Pan | A47B 53/00 | 312/287 |
| 2013/0200767 | A1 * | 8/2013 | Mueller | A47B 96/00 | 312/295 |
| 2019/0145699 | A1 * | 5/2019 | Mellits | F25D 23/067 | 312/406 |

* cited by examiner

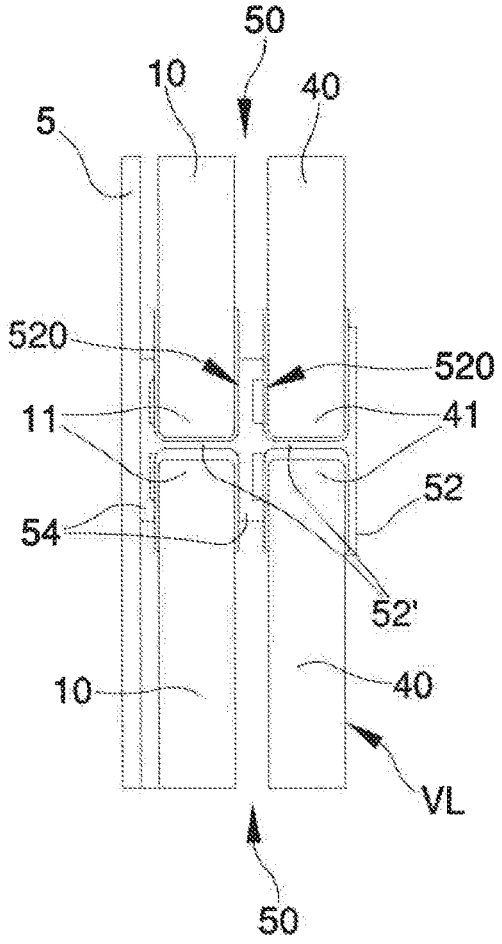
Fig.6
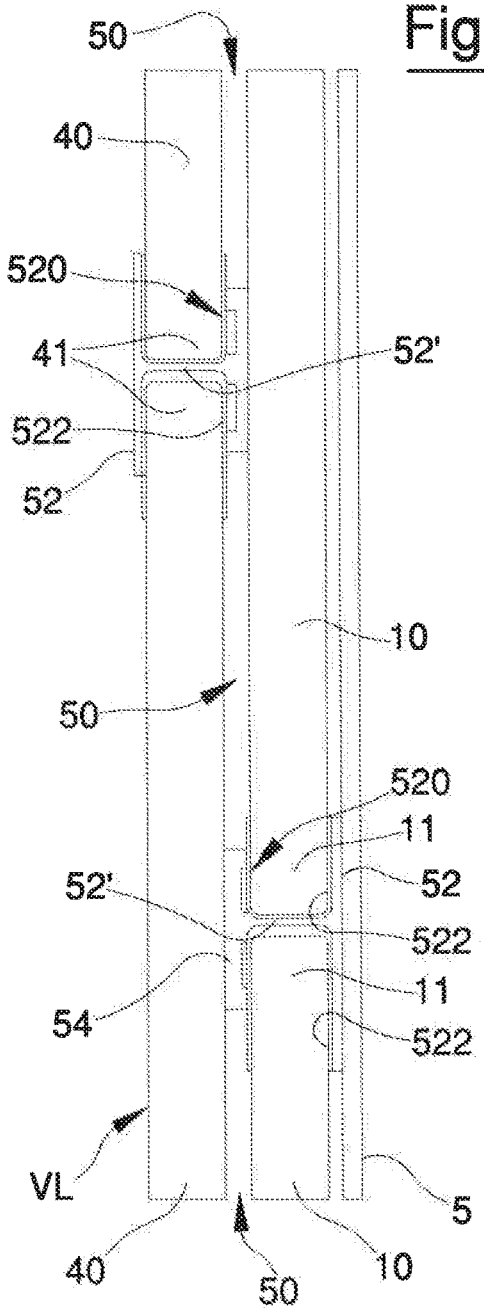
Fig.7
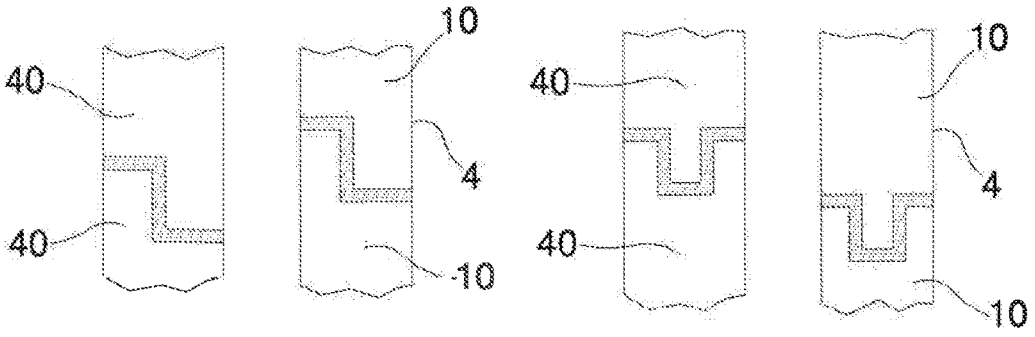
a) Fig.8 b)

ARCHIVE

CROSS-REFERENCE TO RELATED APPLICATIONS

This application claims benefit under 35 U.S.C. § 371 to international application no. PCT/IB2019/060280, filed on Oct. 11, 2019, which claims priority to Italian application no. 102018000010669, filed Oct. 12, 2018, the contents of which are incorporated by reference in their entireties.

FIELD OF INVENTION

The present invention concerns a prismatic archive which extends in a given direction. In particular, the present invention refers to a prismatic archive which extends in a given direction and consists of a plurality of box-shaped containers, movable along a given direction and provided with respective front portions shaped to be selectively coupled as a pack. In greater detail, the present invention refers to a prismatic archive which extends in a given direction and consists of a plurality of box-shaped containers, movable along a given direction, provided with respective front portions shaped to be selectively coupled as a pack and designed to be thermally insulated from the outside.

DESCRIPTION OF THE STATE OF THE ART

In the sector of conservation of articles such as, for example but not limited to, books, works of art, or objects of historical or artistic value or scientific, economic or legal importance, it is common practice to use large archives provided with prismatic box-shaped containers. Said containers are movable individually along a floor guide which extends in a given direction; furthermore, said containers are designed to be compactible in said direction, thus being fluid-tight. The compactability of the containers allows minimization of the space occupied by the archive and the possibility of connecting them frontally through a fire-retardant coupling, by means of frames shaped to mechanically interpenetrate one another and provided with a seal made of heat-resistant plastic material. In particular, seals are known capable of withstanding external temperatures of around 250° C., namely temperatures typical of "cold smoke". Said seals are made of acrylic material, and the relative heat sealing is maximum if the containers between which they are housed are pushed against one another, as normally occurs in the archives described above. If fire prevention is to be effective also at higher temperatures, then the cold smoke seals are replaced with thermal expansion seals which provide passive fire protection. Expansion of the seal creates a tight seal between the containers facing one another and there are seals that are classified according to the duration of their sealing capability.

On the other hand, it should be noted that when the ambient context of the compactable archive contains flammable materials with very high flame temperatures or which can burn for a very long time resulting in particularly high temperature peaks, the solutions described above do not prevent the aforementioned articles from being damaged.

The spontaneous combustion temperature of paper is 233° C. and the resulting fire in buildings statistically has a mean temperature of around 600° C. The UNI 15659 standard purposely reformulated for application on fire-resistant compactable cabinets establishes that the thermocouples positioned inside fire-resistant cabinets must detect a mean temperature increase below 140° C. and the increase for each single thermocouple must be below 180° C. after the first 15 minutes of external flame/heat. Said standard takes the ISO 834 fire curve as its reference for performance of the cabinet approval tests that is an external heat development (external to the cabinets). In particular, according to said curve, the external temperature is approximately 700 degrees after 7 minutes from the start of the fire and approximately 1000 degrees after 60 minutes, with a substantially linear incremental trend over time. The compactable archives described above are not able to provide these performances when the tests are carried out according to the ISO 834 fire curve; on the contrary, the mean temperatures measured inside the archives are already around 80° C. after the first. 7 minutes of external fire, and increase to over 200° C. after approximately 15 minutes from development of the fire and heat. Furthermore, the seals described above which are used to prevent access of the flames and heat to the internal spaces of the archive tend to disintegrate after such prolonged fire times, freeing the spaces between the facing panels; the latter therefore become preferential paths for the high temperature heat capable of sparking flames in items made of paper or similar contained inside the archive.

Therefore, the problem of guaranteeing the conservation of valuable articles as described above in archives provided with movable and compactable containers is currently unresolved and represents an interesting challenge for the applicant, who has devised a totally innovative solution in compliance with the most stringent environmental specifications.

Examples of archives and containers thereof according to the prior art are known from WO 2017/064622, KR 20120073776 and EP 2497389.

SUMMARY OF THE PRESENT INVENTION

The present invention concerns a container for a prismatic archive according to claim 1 and to an archive according to claim 10, further embodiments of the container and archive according to the present invention being defined. by the dependent claims.

According to an embodiment aa disclosed, an archive extends in a given direction. In particular, an embodiment as disclosed refers to a prismatic archive that extends in a given direction and consists of a plurality of box-shaped containers, movable in the given direction and provided with respective front portions shaped to be selectively coupled as a pack. In greater detail, the present invention refers to a prismatic archive that extends in a given direction and consists of a plurality of box-shaped containers, movable in the given direction, provided with respective front portions shaped to be selectively coupled as a pack and designed to be thermally insulated from the outside.

The object of the present invention is to produce an archive provided with a plurality of compactable box-shaped containers which, in addition to limiting and Possibly overcoming the drawbacks typical of the state of the art illustrated above, defines a new standard in the sector of the conservation of cultural articles, precious objects or objects having economic or legal value in order to protect the inside and the relative content from high external temperatures.

The above problems are solved by the present invention according to the independent claims.

According to some embodiments as disclosed a prismatic box-shaped container is provided movable on guides extending in a given direction to produce a compactable archive; said container comprising a plurality of substantially rectangular walls which are connected end to end in a fluid-tight manner to delimit a volume accessible according to said direction through at least one opening; peripheral frame means being carried frontally by said wails adapted to determine, in use, a fluid-tight closing condition of said volume; said air means being adapted to thermally insulate said volume.

According to an embodiment as disclosed, said air means comprise at least one air gap for each said wall.

According to an embodiment as disclosed, each said wall comprises at least one first panel and one second panel which delimit the air gap transversally to said direction.

According to an embodiment as disclosed, connection members have a joint portion provided with a pair of opposing beam pockets adapted to couple end to end two said first panels and/or two said second panels; each said connection member comprising a transverse abutment member extending between one said first wall and one said second wall to space them at a given distance so that each said air gap develops parallel to said direction.

According to an embodiment as disclosed, said air means comprise labyrinth seal members associated with said frame means.

According to another embodiment as disclosed, said seal members are stackable according to said direction.

According to an embodiment as disclosed, said seal members comprise at least a first elongated body coupled with said first panel, arranged transversally to said direction and having a respective substantially "S"-shaped transversal section; a second elongated body shaped so as to be overlapping a projection of said first body in a direction transversal to said given direction for delimiting a clearance developed transversally to said given direction, so as to be stackable with said first body according to said direction.

According to an embodiment as disclosed, said clearance has a section transversal to said given direction and has a substantially "S"-shaped transversal section.

According to an embodiment as disclosed, said seal members comprise a coating associated with each said first body; each said coating being manufactured with a fire-retardant material of inorganic composite type or with a reagent material that increases its volume as the temperature increases and shaped to fully engage said clearance.

According to an embodiment as disclosed, said second body is separate from said first body for being coupled at the front to said second body.

According to an embodiment as disclosed, said air means comprise a plurality of said air gaps transversally overlapped on said direction for each said container, so that said air means are multi-layered.

According to some embodiments as disclosed, a compactable archive is produced comprising at -Least two prismatic box-shaped containers, facing each other through peripheral frame means; each said container comprising a plurality of walls which extend in a given direction and are connected end to end in a fluid-tight manner at respective vertexes to delimit a volume accessible transversally to said direction through at least one opening delimited by said peripheral frame means; characterized in that it comprises air means adapted to thermally insulate said volume.

According to an embodiment as disclosed, said air means comprise at least an air gap for each said wall.

According to an embodiment as disclosed, each said wall comprises at least a first panel and a second panel which delimit the air gap transversally to said direction.

According to an embodiment as disclosed, said air means comprise at least an air gap for each said wall.

According to an embodiment as disclosed, each said wall comprises at least a first panel and a second panel which delimit the air gap transversally to said direction.

According to an embodiment as disclosed, connection members have a joint portion provided with a pair of opposing beam pockets adapted to couple end to end two said first panels and/or two said second panels; each said connection member comprising an abutment member extending between a said first wall and a said second wall to space them at a given distance so that each said air gap develops parallel to said direction.

According to an embodiment as disclosed, said air means comprise labyrinth seal members associated with said frame means.

According to an embodiment as disclosed, said seal members are stackable according to said direction.

According to an embodiment as disclosed, said seal members comprise at least one first elongated body coupled with said first panel, arranged transversally to said direction and having a respective substantially "S"-shaped transversal section; a second elongated body shaped so as to be overlapping a projection of said first body according to a direction transversal to said given direction to delimit a clearance developed transversally to said given direction, so as to be stackable with said first body according to said direction.

According to an embodiment as disclosed, said clearance has a substantially "S"-shaped section transversal to said given direction.

According to an embodiment as disclosed, said sealing members comprise a coating associated with each said first body; each said coating being manufactured with a fire-retardant material of an inorganic composite type or with a reagent material that increases its volume as the temperature increases and shaped for being adapted to fully engage said clearance.

According to an embodiment as disclosed, said second body is separate from said first body for being coupled at the front to said second body.

According to an embodiment as disclosed, said air means comprise a plurality of said air gaps transversally overlapping said direction for each said container, so that said air means are multi-layered.

According to an embodiment as disclosed, at least one pair of said first consecutive panels or of said second consecutive panels are connected end to end through a respective stepped portion.

According to an embodiment as disclosed, at least one said stepped portion is associated with the fire-retardant material.

BRIEF DESCRIPTION OF THE DRAWINGS

Further characteristics and advantages of the archive provided with a plurality of box-shaped containers according to the present invention, will appear clearer from the following description of non-limiting embodiment examples as depicted in the drawings, wherein identical or corresponding parts are identified the same reference numbers. In particular:

FIGS. 6 and 7 illustrate a construction detail necessary for assembling the containers of FIG. 1; and FIGS. 8*a* and 8*b* illustrate variations of FIGS. 6 and 7.

DETAILED DISCLOSURE OF THE PRESENT INVENTION

Figure 1:
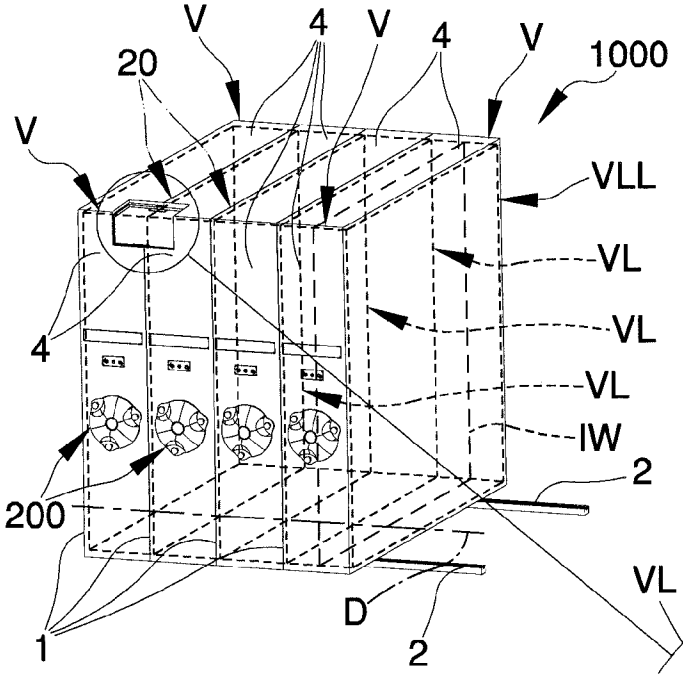
FIG. 1 is a schematic perspective view of an archive provided with a plurality of containers according an embodiment.
Figure 2:
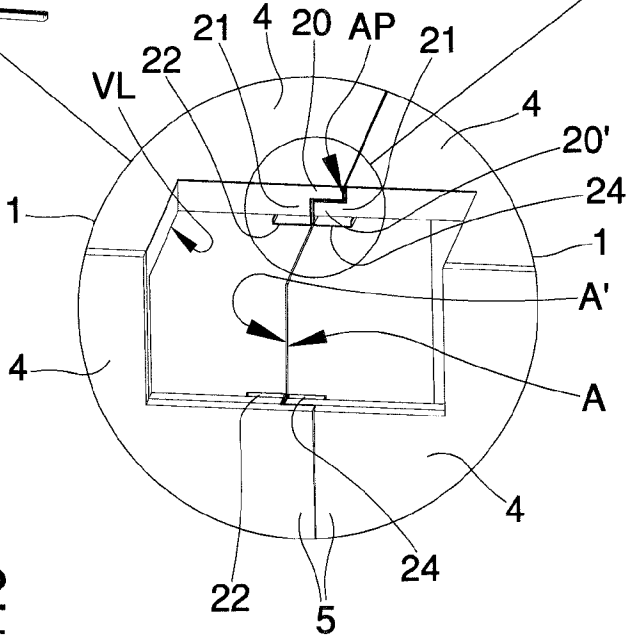
FIG. 2 is an enlarged view of a sectioned upper portion of FIG. 1.

FIG. 1 shows as a whole a compactable archive 1000 which comprises a plurality of substantially parallelepipedal prismatic box-shaped containers 1, movable on rectilinear guides 2 which extend in a given direction ID so as to be accessible according to said direction D and selectively compactable. Each container 1 comprises a plurality of rectangular peripheral walls 4, connected end to end at respective vertexes V to delimit a substantially parallelepipedal internal volume VL (FIGS. 1 and 2). Furthermore, all the walls 4 of each container 1 are oriented. parallel to the direction D horizontally or vertically in FIG. 1 and are connected transversally In a fluid-tight end position, to peripherally delimit a prismatic volume VL (for each container 1) developed according to the direction U and accessible according to the direction D through at least one lateral opening. In fact, in the case of containers 1 positioned at the ends of the archive 1, one single opening A is provided facing the central part of the archive 1000, while each intermediate container 1 is delimited by an opening A and by an opposite opening A', facing the adjoining containers 1. Each opening A and A' is delimited by a respective peripheral frame 20 and 20', provided with at least a step 21 to shape-define a labyrinth clearance AP with an opposite frame 20'/20, carried by an opposite container 1. According to the above description, each clearance AP between the various containers 1 of the archive defines a contactless seal capable of fluid-dynamically insulating the volume VLL inside the archive 1000.

With reference to FIG. 1, at least one of the containers 1 is provided with an inner wall IW transversal to the direction D, where the edges of said wall have been illustrated by a broken line. The object of the wall IW is to divide the volume VL of said container 1 into two portions with partial parallelepiped al volume, the of which can be defined as required, taking account of the dimensions of the material to be filed in the portion detached from the wall. IW in the same container 1. For this purpose, the inner faces of the walls 4 are provided with supporting members for the wall IW known and not illustrated for reasons of economy of text and drawing. For reasons of economy of drawing, said wall IW has been illustrated only in FIG. 1 with reference to the container 1 shown at the right-hand end, but similar walls, also more than one, can be used to equip all the containers 1 of the archive 1000.

With particular reference to FIG. 1, the archive 1000 comprises blocking devices 200 which can be activated by operating members 202, each of which is carried frontally by the front wall 4 of each container 1. Each operating member 202 can be shaped similarly to a steering wheel or, as in FIG. 1, comprise an electromechanical device of known type, adapted to fix the (transversal) position of the containers 1 on the guides 2, so that the frames 20/20' cooperate frontally, with or without direct contact, to close the fluid-tight containers 1 once positioned as a pack on the guides 2. Once each container 1 of the archive 1000 has been coupled with its frames 20/20' interpenetrated with the frames 20'/20 of the adjoining container/s, one single compartment VLL is defined inside the same archive 1000, given by the composition of the volumes VL delimited by the single containers 1 through the respective openings A and the blocking devices 200 render permanent the resulting configuration of said archive 1000.

Figure 3:
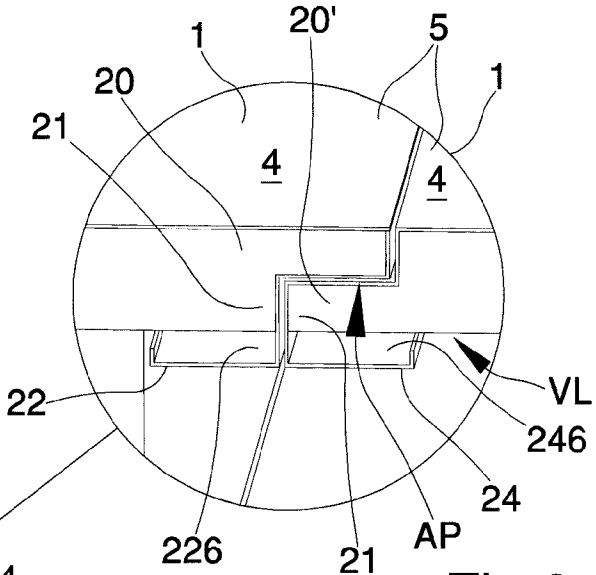
FIG. 3 is an enlarged view of a sectioned upper portion of FIG. 2.

With particular reference to FIGS. 2 and 3, each frame 20/20' has a stepped body 22/24 which extends in the direction transversal to the respective wall 4, is thicker than said wall 4 and comprises a free flap 226/246, folded below the respective wall 4 and parallel to the direction 0. Each flap 226/246 is detached from the respective frame 20/20' by a length ranging from 1 to 15 mm but which could also be different according to given design specifications, without limiting the scope of the present invention.

Furthermore, between the stepped bodies 22/24 a fire-retardant material can be applied of inorganic composite type and/or made of reagent material with volume increasing with temperature, therefore intumescent, to fully engage the clearance AP when, in use, the containers 1 are arranged in a pack and the operating members 202 in the closing position. Given the small size of the spaces between the stepped bodies 22/24, it can be affirmed that fire-retardant material of the type described above is associated with the stepped bodies 22/24.

The use of the containers 1 and the archive 1000 comprising a plurality thereof is easy to understand from the above and does not require any further explanations. On the other hand, it may be useful to specify that the frames 20 and 20' are shaped in a substantially identical manner and overturned by 180°, as can be seen in FIG. 3, to be interpenetrable according to the direction D, whereas the same does not apply to the stepped bodies 22/24, due to the presence of the respective flaps 226/246. Furthermore, each steeped body 22/24 can be produced by folding a metal sheet having constant thickness, without limiting the scope of the present invention.

Lastly, it is clear that modifications and variations can be made to the containers 1 and to the archive 1000 described and illustrated here without departing from the protective scope of the present invention.

Par example, if it is necessary to increase the capacity to insulate the volume VLL of the archive 1000 to a greater extent, modification of the walls 4 could be evaluated, making them of multilayer type, in. The sense that each one would be composed of a plurality of panels, as described below. In particular, with reference to FIG. 4, walls 4 could be produced comprising an outer panel 10 and an inner panel 40, arranged at different distances, so as to define an air gap 50 that develops parallel to the direction D.

It is useful to specify that the first panel 10 and the second panel 40 of wall 4 have substantially trio same extension in the direction P but are coupled in an offset manner by a given distance to impart a given stepped configuration to each respective frame 20/20'.

The thickness of the air gap 50 is substantially constant and will be sized based on the desired insulating capacity to be given to the containers 1 of the archive 1000. The provision of air gaps having thickness between 1 mm and 15 mm can be evaluated, according to design. specifications, and to obtain even more effective insulation, the construction of walls 4 comprising more than two panels 10/40 and more than one air gap 50 can be taken into consideration.

Figure 5:
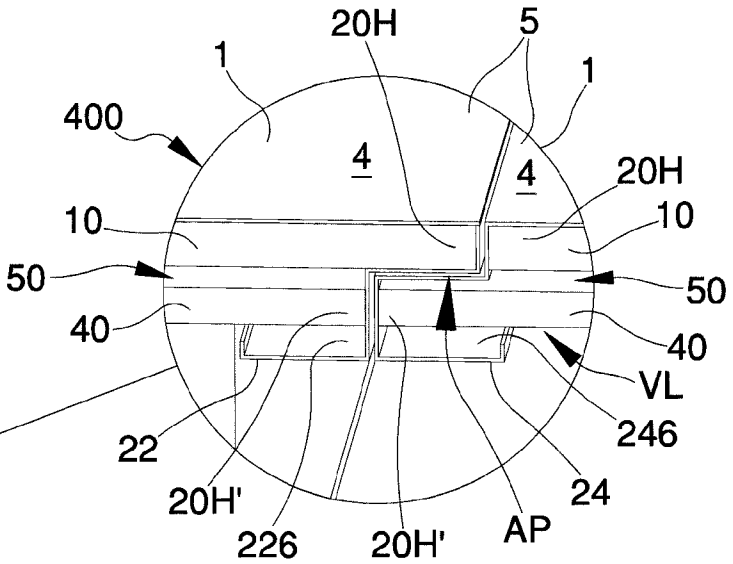
FIGS. 4 and 5 illustrate, respectively, a variation of FIGS. 2 and 3.
Figure 4:
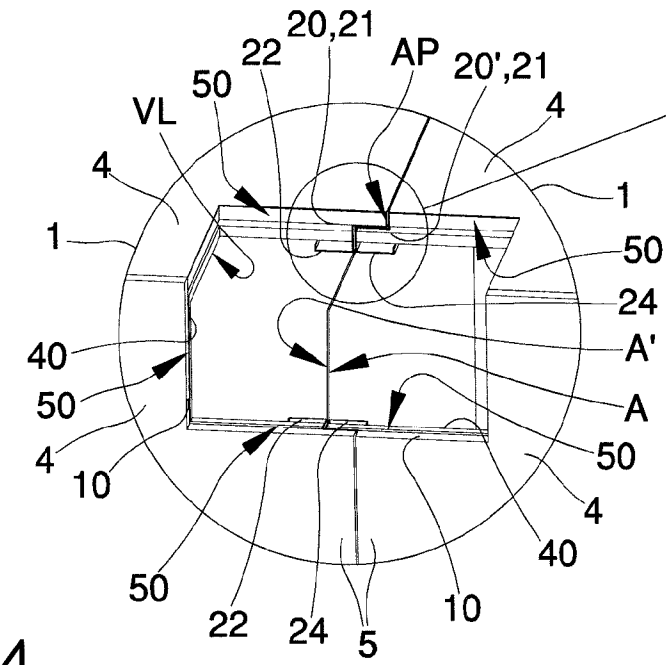

On the other hand, focusing again on FIGS. 4 and 5, the panels 10 and the panels 40 of each wall 4 have respective free end portions 20H and 20H', which are arranged transversally to the direction ID and are longitudinally offset by an interval ranging from 1 mm to 50 mm. In relation to the above description, also in this case, the frames 20 and 20' of two adjacent containers 1 are adapted to join by labyrinth coupling the panels 10 and 40 of two opposite walls 4 without contact between the respective frames 20 and 20', on the side of the respective openings A and A'.

In addition, with particular reference to FIGS. 6 and 7, each panel 10 is protected externally by a metal. plate 5 to define a parallelepipedal-shaped prismatic box surround of the volume VL which can be decorated as required to customise the archive 1000. Also each plate 5 can be separated from each respective panel 10 by an air gap 50, again in order to increase the insulation of each container 1 and, overall, of the archive 1000.

In relation to the above description, the air gaps 50 develop around the volume VL parallel to the direction contributing significantly to increasing the insulation capacity of the wall 4 that comprises them, in addition to the insulating capacity of each panel (first 10 and second 40 and if necessary others overlapping to form a multilayer structure in which the panels 10 and 40 are separated by an air gap 50).

With particular reference to FIGS. 6 and 7, the end coupling between pairs of first coplanar and consecutive panels 10, and the end coupling between pairs of second coplanar and consecutive panels 40, is determined by connection members 52, each provided with a joint portion 52'. Each connection member 52 has at least a pair of opposing beam pockets 520 delimited by two "U"-shaped elements 522. As can be seen from FIG. 7, each element 522 houses an end portion 11 of the first panel 10 or an end portion 41 of the second panel 40. Each joint portion 52' further comprises at least one transversal abutment member 54 which extends between a first panel 10 and a second panel. 40 transversally to the first panels 10/second panels 40 coupled by the two seats 520 and has a given distance to space the first from the second panels 10/40, so as to create two consecutive air gaps 50, according to FIG. 7, which have a substantially parallelepipedal shape in FIG. 6 an abutment member 54 acts as a support for the outer metal plates 5, without limiting the scope of the present invention.

In any case, in relation to the above description, whether each wall 4 comprises a first panel 10 and a second panel 40 spaced transversally to the direction D to delimit one single air gap 50, or whether the air gaps 50 are more than one between further appropriately designed panels, each wall 4 can be considered as a thermal insulation air apparatus 400 (FIG. 5) comprising panels 10/40 alternating with air gaps 50 or, if preferred, organized substantially in a sandwich of panels and air gap.

Furthermore, if further increase in the insulation capacity of the walls 4 is desired, the result can be obtained by modifying the end coupling of the respective first and second consecutive panels 10 and 40 to increase the length of, and make more tortuous, the path of the hot gases inside the walls 4, so as to further increase the insulating power of the archive 1000. In particular, with reference to FIGS. 8*a*) and 8*b*), end portions 11 and 41 of the first and/or second consecutive panels 10/40 could be stepped-shaped and, in particular, "S" or "U"-shaped, or combine said solutions in other ways. Furthermore, also said stepped portion could be associated with fire-retardant, for example intumescent, material.

Naturally said solution is practicable also if the walls 4 are composed of one single panel as in FIGS. 2 and 3.

In relation to the above description, the set of frames 20/20', air gaps 50, and respective first panels 10 and second panels 40 (and any others that may be added to them) that compose the walls 4 associated with the containers 1 and, in short, with the archive 1000, define overall a thermal apparatus whose capacity to insulate the respective internal volume VL from any heat released to the outside is particularly increased with respect to products conceived for analogous use. It can be easily understood that the thickness of the walls 4, determined by the number of first panels 10 and second panels 40, and air raps 50 and relative thickness defined by the joints 52, will determine the maximum value of the effective heat load to which the archive 1000 can be subjected, guaranteeing optimal conservation of the relative contents.

The invention claimed is:

1. A container for a compactable archive comprising a plurality of said containers movable on guides extending in a given direction to define said compactable archive; said container being peripherally delimited by a plurality of substantially rectangular walls parallel to said direction, having given thickness and transversally connected end to end and in a fluid-tight manner to peripherally delimit a prismatic volume developed according to said direction and accessible according to said direction through at least one opening transversal to said direction; each said opening being delimited by a peripheral frame; wherein each said frame has at least one step for shape-defining a labyrinth clearance with an opposing frame wherein each said wall has a multilayer structure provided with at least a first panel and a second panel overlapping to delimit an air gap having given thickness and developed parallel to said direction; said first panel and said second panel of each said wall having a substantially identical extension in said direction to impart a given stepped shape to each respective said frame, the container further comprising connection members having a joint portion provided with a pair of opposing beam pockets designed to couple, end to end, two of said first panels and/or two of said second panels; each said connection member comprising a transversal abutment member extending between one said first wall and one said second wall for spacing them apart at a given distance, so that each said air gap develops parallel to said direction.

2. The container according to claim 1, wherein each said frame carries a stepped body which extends in a direction transversal to the respective said wall, is thicker than said wall and comprises a free flap folded below the respective said wall, parallel to said direction.

3. The container according to claim 2, wherein said flap is detached from said frame.

4. The container according to claim 2, wherein each said stepped body is associated with fire-retardant material of inorganic composite type and/or with a reagent material that increases its volume as the temperature increases to fully engage said clearance.

5. The container according to claim 1, wherein at least one pair of said first consecutive panels or said second consecutive panels are coupled end to end through a respective stepped portion.

6. The container according to claim 5, wherein said stepped portion is "U"-shaped or "S"-shaped.

7. The container according to claim 6, wherein a fire-retardant material is associated with at least one said stepped portion.

8. The container according claim 1, further comprising at least one inner wall transversal to said direction to divide said prismatic volume into at least two parts.

9. A compactable archive comprising at least two containers movable individually on guides extending in a given direction; each said container being peripherally delimited by a plurality of substantially rectangular walls parallel to said direction having given thickness and connected transversally end to end and in a fluid-tight manner to peripherally delimit a prismatic volume developed according to said direction and accessible according to said direction through at least one opening transversal to said direction; each said opening being delimited by a peripheral frame; wherein each said frame has at least one step to define a shape seal with an opposing frame, wherein each said wall has a multilayer structure provided with at least one first panel and one second panel overlapping to delimit an air gap having given thickness and developed parallel to said direction; said first panel and said second panel of each said wall having different extension in said direction to give a stepped shape to each respective said frame, the archive further comprising connection members having a joint portion provided with a pair of opposing beam pockets adapted to couple end to end two said first panels and/or two said second panels; each said connection member comprising a transversal abutment member extending between one said first wall and one said second wall to space them at a given distance so that each said air gap develops parallel to said direction.

10. The archive according to claim 9, wherein each said frame has a stepped body which has a thickness greater than said wall and comprises a free flap folded below the respective said wall, parallel to said direction.

11. The archive according to claim 10, wherein said flap is detached from said frame.

12. The archive according to claim 10, wherein each said stepped body is associated with a fire-retardant material of inorganic composite type and/or with a reagent material that increases its volume as the temperature increases to fully engage said clearance.

13. The archive according to claim 9 further comprising at least one inner wall transversal to said direction to divide said prismatic volume into at least two parts.

* * * * *